United States Patent [19]

Rachner et al.

[11] Patent Number: 4,570,552

[45] Date of Patent: Feb. 18, 1986

[54] PROCESS AND APPARATUS FOR DELIVERING CARBON MATERIAL TO A FURNACE

[75] Inventors: Hans-Günther Rachner, Essen; Hans-Herrmann Boiting, Steinfurth, both of Fed. Rep. of Germany

[73] Assignee: Paul Wurth S.A., Luxembourg

[21] Appl. No.: 632,527

[22] Filed: Jul. 19, 1984

[30] Foreign Application Priority Data

Jul. 19, 1983 [DE] Fed. Rep. of Germany ..... 3325901

[51] Int. Cl.[4] ..... F23D 1/00

[52] U.S. Cl. ..... 110/347; 110/101 CC; 110/101 CD; 110/101 CF; 110/104 R; 406/197

[58] Field of Search ..... 110/104, 101 CD, 101 CC, 110/101 CF, 347; 222/368; 406/194, 197

[56] References Cited

U.S. PATENT DOCUMENTS

| | | | |
|---|---|---|---|
| 4,257,334 | 3/1981 | Mueller | 110/104 R |
| 4,373,451 | 2/1983 | Gardner et al. | 110/101 CC |
| 4,389,949 | 6/1983 | Heep | 110/101 CC |
| 4,441,434 | 4/1984 | Howard | 110/104 R X |

*Primary Examiner*—Edward G. Favors
*Attorney, Agent, or Firm*—Fishman & Dionne

[57] ABSTRACT

A process and apparatus for delivering carbon i.e., coal dust, to be combusted in a furnace is presented. The furnace is of the type having plural combustion points and may include a shaft furnace such as, for example, a blast or cupola furnace. The carbon dust is delivered in dosed quantities to each of the individual combustion points in a separate air stream which is under a predetermined pressure. The carbon (coal dust)/carrier gas (air) is delivered to each combustion point in the furnace at super critical speed, i.e., the speed of sound, the carrier gas having a relatively high proportion of solid material therein. The actual quantity of carbon material delivered to each combustion point is directly detected and monitored as a consequence of volumetric measurement and is appropriately corrected by means of a secondary air supply when the carbon quantity either exceeds or falls below a predetermined nominal value. The apparatus of the present invention includes plural conveyor lines being connected at one end thereof to a particular combustion point. The end of the conveyor line which is connected to the combustion point comprises a nozzle which delivers the carbon/carrier gas stream at a super critical outflow speed. The diameter of the nozzle and the predetermined pressure prevailing in the conveyor line is a function of the preselected nominal quantity of carbon which is to be delivered to the furnace.

31 Claims, 1 Drawing Figure

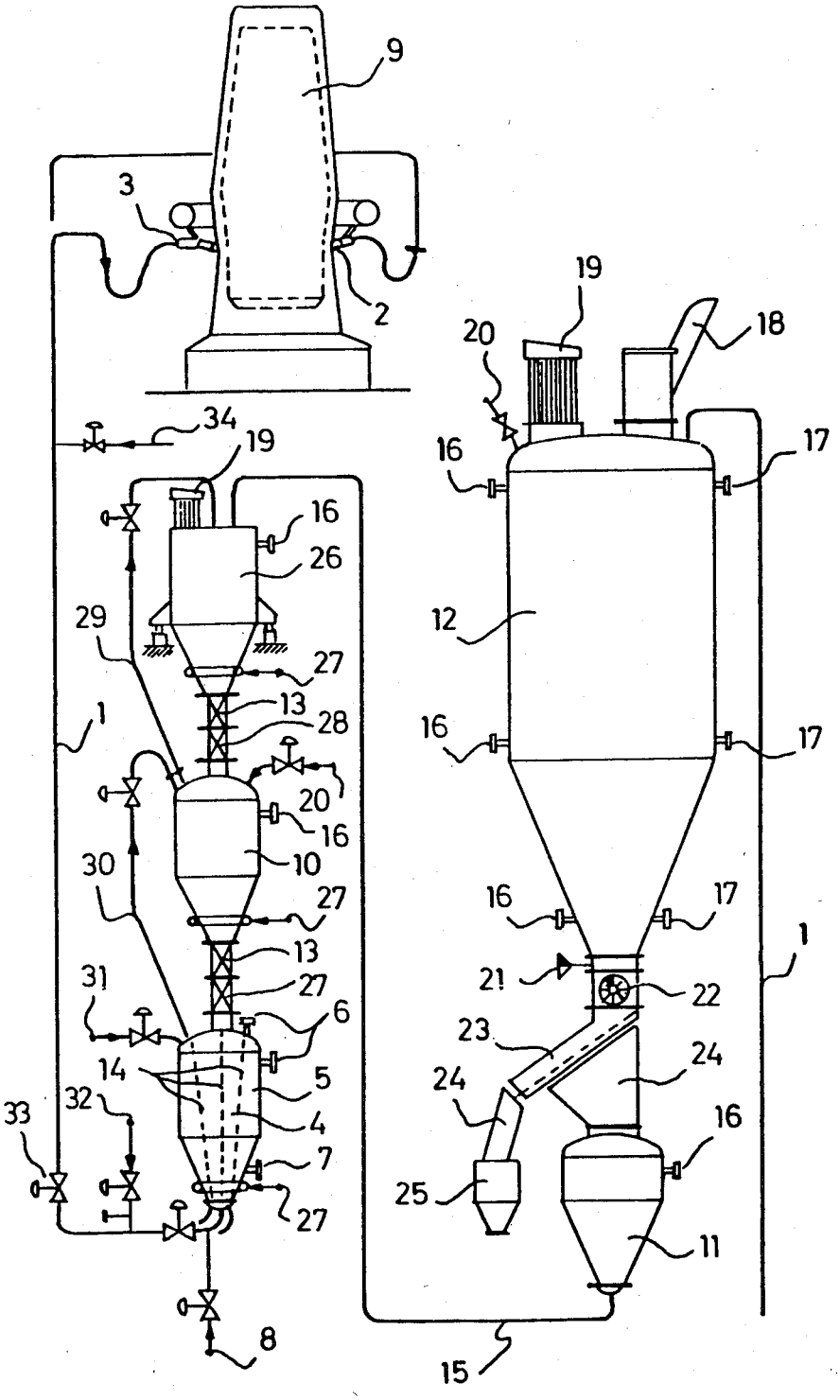
9
3
2
19
20
18
34
19
16
17
16
26
12
29
27
13
28
1
16
17
20
16
10
30
27
16
17
13
1
27
21
22
31
6
23
24
14
5
24
32
4
16
33
7
25
27
11
8
15

PROCESS AND APPARATUS FOR DELIVERING CARBON MATERIAL TO A FURNACE

BACKGROUND OF THE INVENTION

This invention relates to a process and apparatus for blowing or delivering coal and other carbonaceous dust to be combusted in a furnace of the type having several combustion points. More, particularly, this invention relates to a process and apparatus for delivering coal dust to an industrial furnace, particularly, a shaft furnace such as, for example, a blast or cupola furnace, wherein the coal dust is fed in dosed quantities to plural combustion points in separate air streams which are under a predetermined pressure. As mentioned, this invention also relates to an apparatus for delivering carbonaceous dust for combustion in an industrial furnace having plural combustion points. The apparatus comprises several conveyor lines or systems, each leading to a combustion point, for the coal carbon/carrier gas stream to be blown therein and which is under a predetermined pressure. Each conveyor line is connected at its end farthest removed from the combustion point to a pressure vessel which contains coal dust under a predetermined pressure and which is fluidized by air.

In recent years, particularly since the several "oil crises", a very considerable increase in fuel oil prices have occured. Consequently, the possibility of future shortages of available oil and further price increases have been resulting in efforts being made throughout the world to reduce the consumption of fuel oil. Accordingly, considerable efforts have a been made, particularly in the case of industrial firing installations i.e., industrial furnaces, to replace fuel oils by cheaper sources of carbon which are readily available outside the oil producing countries. The most readily available and cheapest source of such carbon is finely crushed coal in the form of coal dust.

Various apparatii for blowing coal dust into, for example, blast furnaces, have previously been developed in the United States and in the Peoples Republic of China. Apparatii of the type especially suitable for cupola furnaces have also been developed in the United States. Similarly, cylindrical rotary kilns for producing cement have been converted to coal firing processes and like efforts are being made at present to appropriately convert shaft furnaces in the same respect for the production of burnt lime.

Generally, in prior art processes and apparatii of the type discussed above, carbon in the form of coal dust has been delivered to plural combustion points in the furnace via volumetric or gravimetric quantities in a stream of carrier gas, i.e., conveying air. The quantity of carbon/carrier gas flowing into the furnace fluctuates as a function of the prevailing pressure in the furnace. It will be appreciated that the fluctuating internal pressure in the furnace may be caused by the different bulk densities of the material which have already been deposited in the furnace. However, it will also be appreciated that a fluctuation in the quantity of carbon/carrier gas fed to the furnace is undesirable from a stand point of efficiency and control.

While the fluctuating pressure and resulting uneven quantity of carbon being fed to the furnace as discussed above is an important disadvantage of the known processes and apparatii for delivering coal dust to an industrial furnace, another important disadvantage is that the quantity of coal being fed to each of the plural combustion points cannot be directly or indirectly determined as a function of the quantity of coal being delivered. In fact, in order to ascertain the quantity of coal dust fed to each combustion point, (and consequently to monitor uniform charging of carbon to the furnace at the individual combustion points), measured variables such as the pressure in the carbon/carrier gas stream must be used. However, it should be understood that such measured variables will not yield reliable information.

Furthermore, prior art coal dust blowing or delivering apparatus have been extremely expensive to manufacture and maintain. For example, in a well known blowing apparatus of the type hereinabove discussed, an individual cellular-wheel sluice having an appropriate control circuit must be assigned to each conveyor line leading to a combustion point in the furnace. Thus, for example, when 20 or 30 combustion points are present in a furnace, there is obviously a considerable outlay or expense in terms of investment and resulting costs for maintenance, repairs, etc.

SUMMARY OF THE INVENTION

The above discussed and other problems of the prior art are overcome or alleviated by the process and apparatus for delivering carbon, i.e., coal dust, to plural combustion points in a furnace of the present invention. In accordance with the present invention, the quantity of carrier gas i.e., conveying carbon, i.e., and coal dust fed to each combustion point remains essentially constant at a predetermined value. Unlike the prior art processes discussed above, these quantities are kept constant irregardless of the particular counterpressure prevailing in the interior of the furnace. Moreover, unlike the prior art discussed above, in accordance with the present invention, the quantity of coal dust being delivered to each combustion point may be directly monitored. Furthermore, in the event of a failure at a particular combustion point the present invention provides simple correcting methods to retain a constant total thermal power supplied to the furnace.

In accordance with the present invention, a predetermined nominal quantity of coal dust and carrier gas delivered to a particular combustion point is blown at supercritical speed i.e., the speed of sound, into the furnace at a predetermined pressure, the carrier gas being supplied with a relatively high, effective proportion of solid carbon materials, i.e., coal dust. Consequently, the quantity of carbon material fed to each combustion point may be directly detected as a result of volumetric measurement. Moreover, the amount of carbon being delivered may be adjusted or corrected by means of a secondary gas supply, such as when the quantity of coal dust exceeds or falls below a predetermined nominal-quantity value.

In accordance with the apparatus of the present invention, plural conveyor lines feed the plural combustion points located at various points along the furnace. At the outflow or blowing end of each conveyor line (located at each combustion point), a nozzle is provided which operates at a supercritical outflow speed, the diameter of which corresponds to a predetermined quantity of coal dust to be blown therein. The predetermined prevailing pressure in each conveyor line (or a delivering vessel which is located upstream of each conveyor line) is selected to match the quantity of coal dust which is to be blown into the furnace. Preferably, the nozzles may be exchanged for nozzles of different diameters depending upon the quantity of material which is to be delivered to the furnace.

The above discussed and other advantages of the present invention will be apparent to and understood by those skilled in the art of the following detailed description and drawings.

BRIEF DESCRIPTION OF THE DRAWING

The single FIGURE of the drawing shows a schematic diagram of the apparatus in accordance with the present invention.

DESCRIPTION OF THE PREFERRED EMBODIMENT

In accordance with the process of the present invention, carbon (preferably coal dust) and carrier gas (preferably air) are fed or delivered to a particular combustion point in a furnace at supercritical speeds, i.e., at about the speed of sound, and at a predetermined pressure. An important feature of the present invention is that the carrier gas is provided with a relatively high proportion of solid coal dust materials. As a result, the quantity of carbon supplied to each combustion point is directly detected as a result of volumetric measurement. This quantity may be easily corrected by means of a secondary air supply when the coal dust exceeds or falls below a predetermined nominal quantity.

As a result of the supercritical inflow or delivery speed to each individual combustion point of the furnace, it possible to ensure that the carbon/carrier gas mixture entering the furnace at selected combustion points travel at a constant speed and is provided with a constant proportional amount of carbon material. This will be so even when the counter pressure at a particular combustion point is fluctuating as discussed above in the background of the invention. As already mentioned, in contrast to the prior art, the carrier gas/coal dust stream must be provided with a relatively high proportion of solid material so as to effect a constant proportion of carbon material in the carrier gas despite any fluctuations of the counterpressure prevailing in the interior of the furnace. An example of a relatively high proportion of carbon material: carrier gas, i.e., an "effective proportion" which effects a constant quantity of carbon fed to each combustion point is 50 kilograms of carbon dust per kilogram of air.

In accordance with the present invention, and unlike the prior art, the quantity of carbon fed to a particular combustion point may be directly detected. If, during this detection process, it is found that a predetermined nominal quantity of carbon has been exceeded in the carrier gas, an appropriate correction may be easily effected (at least in a range of plus or minus 20%) by increasing the secondary air stream introduced into the particular carbon/conveying air stream. This introduction of secondary air will result in a reduction in the proportion of solids to carrier gas in that particular particle stream. Conversely, when the quantity of carbon flows below the intended nominal quantity, the proportion of secondary air being fed to the coal dust/conveying air stream may be correspondingly lowered.

While a method of correcting the proportion of carbon to carrier gas has been described above relative to individual corrections at a particular combustion point in the furnace, in accordance with the present invention, the pressure variation in the carbon/carrier gas stream may also be monitored using the total thermal power supplied to the furnace as a reference point. Consequently, the total carbon supplied to all of the combustion points in the furnace is preferably increased or reduced within specific limits of, for example, plus or minus 20%.

Volumetric measurement and the resultant indication of the quantity of the carbon fed to a particular combustion point is preferably carried out by measuring the length of time which elapses when a predetermined quantity of carbon flows between two level marks from a pressurized "blowing in" or delivery vessel, each individual combustion point being connected to a separate chamber.

In accordance with the apparatus of the present invention, conveyor lines are provided which terminate at each particular combustion point along the furnace. At the outflow or blowing end of each conveyor line (located at each combustion point) a nozzle is provided which operates at a supercritical outflow speed, the supercritical outflow speed corresponding to the speed of sound. The diameter of the nozzle is constructed so as to correspond to a predetermined quantity of carbon which is to be blown therethrough. Thus, the nozzle diameter will be a function of the quantity of carbon to be delivered at a predetermined pressure prevailing in the conveyor line (or a blowing vessel located upstream of the conveyor line). The nozzles are preferrably designed so that they can be exchanged for other nozzles of varying diameter.

In a preferred embodiment of the present invention, a pressure vessel is provided which acts as a "blowing in" or delivery vessel and has a number of pocket shaped chambers therein corresponding to the amount of combustion points in the furnace. Each of these chambers are filled with fluidized coal dust and are connected to an individual conveyor line which terminates at one of the combustion points. An important feature of each chamber is the presence of a first detector for detecting a predetermined upper filling level and a second detector for detecting a predetermined lower filling level in the chamber. These detectors interact with a timing device, the timing device being actuated when the first detector detects or communicates with solid material and the timing device switching off when the solid material reaches the second detector. The timing device thus determines the out flow time of a predetermined nominal quantity of carbon material which is provided between the two detectors in each chamber and which will result in an accurate monitoring of the quantity of carbon being fed to the furnace.

As mentioned, irregularities in the quantities of carbon which is delivered to each combustion point may be easily corrected in accordance with the teachings of the present invention. Accordingly, each conveyor line is preferrably connected to a secondary air source, from which a controllable quantity of secondary air can be fed into a particular conveyor line. The amount of secondary air fed to each conveyor line may be reduced or increased in accordance with an increase or reduction in the quantity of carbon which is conveyed to a combustion point via that conveyor line. Thus, the proportion of solid carbon material to carrier gas may be individually controlled at each combustion point through each conveyor line.

As mentioned in regard to the description of the process in accordance with the present invention, the pressure generated in the "blowing in" or delivery vessel and consequently that pressure prevailing in each conveyor line can be controlled, so as to increase or reduce the total thermal power (i.e., quantity of coal dust) supplied to the furnace. This pressure may be automatically raised, if appropriate, when the required quantity of coal to be blown into the furnace is to be increased or when at least one combustion point fails during constant coal requirements.

As mentioned, a chamber in the pressurized delivery vessel is allocated to each of the individual conveyor lines or combustion points. Preferrably, the chamber has an open insert at the top thereof which is essentially star shaped in a horizontal section and which forms the plural chambers which are connected to the plural conveyor lines. The pressurized delivery vessel is preceded by a sluice vessel which is to be fed with carbon, i.e., coal dust, fluidized by a carrier gas, i.e., air, from a supply silo or the like by means of a pneumatic conveyor. This pneumatic conveyor is connected to the delivery vessel via a suitable shut off valve.

As mentioned, the first detectors are assigned to a specific filling level in the chambers and are actuated by material which has reached that particular surface level in the chamber. Consequently, the first detector transmits a signal to a timing device which operates until the material has reached a surface level in that chamber corresponding to the second detector. As a result, the process and apparatus of the present invention determines the specific time required for a specific quantity of carbon to flow out of the chamber and into the particular conveyor line. It will be appreciated that the corresponding times for all of the plural chambers, for example, thirty chambers, may be digitally displayed on a luminous board to a plant manager or supervisor. In this way, the quantity of carbon actually flowing to each combustion point may be directly ascertained by means of the above described timing measurement. This is an important feature of the present invention and is not found in prior art methods and apparatus.

If the supervising crew notes that the quantity of coal being fed to a particular combustion point exceeds or falls below a predetermined tolerance range, the problem can be corrected by increasing or reducing the secondary air which is fed into that particular conveyor line thereby resulting in a reduced specific proportion of coal dust in the conveying air and consequently in a reduced quantity of coal dust being delivered out of a particular nozzle.

The present invention will now be explained in more detail below with reference to the single FIGURE of the drawing wherein a preferred embodiment of an apparatus in accordance with the present invention is shown for carrying out the process of the present invention. Referring to the FIGURE, an apparatus is shown for delivering carbon, i.e., coal dust, to be combusted in an industrial furnace 9 having plural combustion points 2 therein. Each combustion point 2 has a conveyor line 1 which is connected thereto. The carbon/carrier gas (coal dust/conveying air) stream is delivered into the furnace 9 via the plural conveyor lines 1. Conveyor lines 1 are each connected to and terminate at a respective combustion point 2 at one end and to a pressurized delivery or "blowing in" vessel 4 having coal dust therein at a second end. Pressurized delivery vessel 4 is maintained under a predetermined pressure and is fluidized by air.

In accordance with the present invention, each conveyor line 1 is provided, at the out flow end thereof i.e., combustion point 2, with a nozzle 3 capable of operating at a super critical (speed of sound) outflow speed. With a predetermined pressure prevailing in the conveyor line 1, the diameter of nozzle 3 is chosen in accordance with a preselected quantity of carbon which is to be blown into furnace 9. As discussed, in order to obtain alternative quantities of carbon, nozzles 3 may be replaced with other nozzles of varying diameter. Thus, the amount of coal dust which is delivered to each combustion point 2 is a function, in part, of the diameter of the nozzle 3.

The particular quantity of carbon material fed to a combustion point 2 is directly detected and monitored as a result of volumetric measurements and, as mentioned, may be appropriately corrected by means of a secondary air supply. As discussed, the secondary air will be supplied when the quantity of carbon being delivered to the furnace 9 exceed or falls below the predetermined nominal value. Volumetric measurements are achieved by providing pressure vessel 4 with plural chambers 5 corresponding to the numbers of combustion points 2. Each chamber 5 is filled with fluidized carbon material and each chamber 5 is connected to a conveyor line 1 which leads to a combustion point 2. The chambers 5 are each provided with a first detector 6 for detecting a predetermined upper filling level and a second detector 7 for detecting a predetermined lower filling level. Detectors 6 and 7 interact with a timing device which is preferrably actuated when the fluidized carbon reaches the first detector 6. The timing device is then switched off when the fluidized carbon reaches the second detector 7. The timing device thus determines the out flow time of a quantity of carbon which is present between the two detectors 6 and 7 in each chamber 5. As the density of the carbon/carrier gas stream is essentially constant and as the volume or space defined between the detectors is known, the time it takes for the fluidized carbon to flow between the two detectors 6 and 7 corresponds to a specific quantity of coal dust.

In accordance with the present invention, when the nominal preselected quantity of carbon which is to be delivered at a particular combustion point 2 is exceeded, the secondary air stream is introduced into the coal dust/conveying air stream. The secondary air stream is then lowered when the quantity of carbon material in the carrier gas falls below the nominal quantity. Referring to the FIGURE, conveyor lines 1 are each connected to a secondary air source 8 from which a controlled quantity of secondary air can be fed into a particular conveyor line 1.

It will be appreciated that in the embodiment of the present invention shown in the FIGURE, pressure vessel 4 is likewise controllable. Thus, when the quantity of carbon which is to be delivered into furnace 9 is to be increased or when one or more combustion points 2 fail during constant coal requirements, the pressure prevailing in pressurized vessel 4 may be automatically increased.

Still referring to the FIGURE, pressure vessel 4 is preceded in the down flow direction by a sluice vessel 10. Sluice vessel 10 is supplied with coal dust (having been fluidized by air) flowing from a supply silo 12 via a pneumatic conveyor 11. Sluice vessel 10 is connected to pressure vessel 4 via a valve member 13. In a preferred embodiment, pressure vessel 4 is provided with an insert 14. Insert 14 is essentially star shaped in a horizontal section and forms the chamber 5.

In the apparatus shown in the FIGURE the carbon material is delivered to supply silo 12 by means of a coal dust conveyor or deliver line 15. In order to monitor and safeguard the supply silo 12, filling level probes or detectors 16, temperature probes 17, an explosion door 18, a bag filter 19 and a low pressure protection 20 are provided at various points on supply silo 20 as indicated in the FIGURE.

Other feature of the apparatus of the present invention is a flat slide 21 and cellular wheel sluice 22 positioned between the supply silo 12 and pneumatic conveyor 11. Cellular wheel sluice 22 is followed by a screening channel 23 which is located above a funnel 24 and which is connected to the pneumatic conveyor 11. Funnel 24 guides seperated and undesirable coarse grains of carbon to a coarse grain container 25. Preferrably, a further level detector probe 16 is provided on the pneumatic conveyor 11 to insure proper monitoring and control.

Another feature of the apparatus of the present invention is that the solid carbon material is delivered by pneumatic conveyor 11 via a coal dust conveyor line 15 to a pressureless weighing container 26. As with the other vessels, weighing container 26 is provided with a level detector probe 16 and bag filter 19. Located between weighing container 26 and downstream sluice vessel 10 is a device 27 for adding additional air. At the downstream end of container 26 is a shut-off valve 13 and a gas flap 28 having seat cleaning. Preferrably, weighing container 26 and sluice vessel 10 are connected to one another via a venting line 29. Similarly, sluice vessel 10 and pressurized delivery vessel 4 are also connected to one another via a pressure compensating line 30. Still referring to sluice vessel 10, a pressurizing line 20 is attached thereto to provide and control the necessary pressure therein. Also, sluice vessel 10 is provided with a level detecting probe 16 in the lower region thereof and to a device 27 for adding additional air.

Pressure vessel 4 is connected to an air line 31 and includes a device 27 located at the lower region thereof for adding additional air thereto. Moreover, if desired, each of the conveyor lines 1 may be provided with additional air via the connection thereof to an air line 32. It will be appreciated that a shut off valve 33 is provided to conveyor line 1 in the event of a tuyere failure. Also, a line 34 for delivering cooling air is connected to each conveyor line 1.

It will be appreciated that the above described embodiment of the apparatus of the present invention has merely been shown as an example and that many other variations thereof may equally be constructed in accordance with the present invention. Thus, while a preferred embodiment has been shown and described, varies modifications and substitutes may be made thereto without departing from the spirit and scope of the invention. Accordingly, it is to be understood that the present invention has been described by way of illustrations and not limitation.

What is claimed is:

1. A process for delivering dosed quantities of carbon to separate streams of a carrier gas under a predetermined pressure, the separate carbon/carrier gas streams being delivered to a plurality of combustion points in a furnace including the steps of:

supplying each separate carrier gas stream with an effectively high proportion of carbon material to create an essential constant density of carbon in said separate carrier gas stream;

detecting the quantity of carbon which is delivered to each combustion point based on a volumetric measurement of the carbon/carrier gas stream;

delivering a pre-selected, nominal quantity of said carbon to the plural combustion points of the furnace at an essentially supercritical speed; and supplying a secondary carrier gas stream to said carbon/carrier gas stream to correct the quantity of carbon being delivered to said combustion points when said quantity is higher or lower than said pre-selected nominal quantity.

2. The process of claim 1 wherein the step of supplying a secondary carrier gas stream includes:

increasing the quantity of said secondary carrier gas stream supplied to said carbon/carrier gas stream when said nominal quantity of carbon at least one of said combustion points is exceeded.

3. The process of claim 1 wherein the step of supplying a secondary carrier gas stream includes:

decreasing the quantity of said secondary carrier gas stream supplied to said carbon/carrier gas stream when said nominal quantity of carbon at at least one of said combustion points is diminished.

4. The process of claims 1, 2 or 3 including the step of:

increasing the pressure in said carbon/carrier gas stream when said nominal quantity of carbon at at least one of said plural combustion points is diminished.

5. The process of claims 1, 2 or 3 including the step of:

decreasing the pressure in said carbon/carrier gas stream when said nominal quantity of carbon at at least one of said plural combustion points is exceeded.

6. The process of claims 1, 2 or 3 wherein said step of detecting the quantity of carbon delivered to each combustion point includes:

measuring the time which elapses when a quantity of said carbon supplied to said carrier gas flows between a pair of detectors in a pressurized vessel, the space between said detectors defining a preselected volume.

7. The process of claim 1 wherein:

said effectively high proportion of carbon material is 50 Kg of carbon per Kg of carrier gas.

8. The process of claims 1 or 7 wherein:

said carbon is coal dust.

9. The process of claims 1 or 7 wherein:

said carrier gas is air.

10. The process of claim 1 wherein:

said furnace is a shaft furnace.

11. The process of claim 10 wherein:

said shaft furnace is selected from the group consisting of blast furnaces and cupola furnaces.

12. An apparatus for delivering dosed quantities of carbon to separate streams of a carrier gas under a predetermined pressure, the carbon/carrier gas streams being delivered to a plurality of combustion points in a furnace including:

means for supplying the carrier gas with an effectively high proportion of carbon material to create an essentially constant density of carbon in said carrier gas;

means for detecting the quantity of carbon which is delivered to each combustion point, based on a volumetric measurement of the carbon/carrier gas stream;

means for delivering a pre-selected, nominal quantity of said carbon to the plural combustion points of the furnace at an essentially supercritical speed and means for supplying a secondary carrier gas stream to said carbon/carrier gas stream to correct the quantity of carbon being delivered to said combustion points when said quantity is higher or lower than said pre-selected nominal quantity.

13. The apparatus of claim 12 wherein the means for supplying a secondary carrier gas stream includes:

means for increasing the quantity of said secondary carrier gas stream supplied to said carbon/carrier gas stream when said nominal quantity of carbon at at least one of said combustion points is exceeded.

14. The apparatus of claim 12 wherein the means for supplying a secondary carrier gas stream includes:

means for decreasing the quantity of said secondary carrier gas stream supplied to said carbon/carrier gas stream when said nominal quantity of carbon at one of said combustion points is diminished.

15. The apparatus of claim 12 including:

means for increasing the pressure in said carbon/carrier gas stream when said nominal quantity of carbon at at least one of said plural combustion points is diminished.

16. The apparatus of claim 12 including:

means for decreasing the pressure in said carbon/carrier gas stream when said nominal quantity of carbon at at least one of said plural combustion points is exceeded.

17. The apparatus of claim 12 wherein said delivery means includes:

a plurality of conveyor line means leading to each of said combustion points and leading from a pressurized vessel; and first nozzle means, said nozzle means positioned between said conveyor line means and said combustion points, said nozzle means accelerating said carbon/carrier gas stream to said supercritical speed, and said nozzle means having a selected diameter wherein a selected quantity of carbon corresponding to said nominal quantity will flow therethrough.

18. The apparatus of claim 17 wherein:

said nozzle means having said first diameter are interchangeable with nozzle means of other diameters in order to vary the quantity of carbon flowing therethrough.

19. The apparatus of claim 12 wherein said detection means comprises:

a pressurized delivery vessel;

a plurality of chambers within said delivery vessel, the number of chambers being equal to the number of combustion points in said furnace, said chambers communicating with said combustion points, said carbon/carrier gas stream flowing through each of said chambers;

first detector means for detecting said carbon/carrier gas stream at a first point along each of said chambers;

said detector means for detecting said carbon/carrier as stream at a second point along each of said chambers;

timing device means wherein the quantity of carbon flowing between said first and second detector means is determined as a function of the volume between said first and second detector means.

20. The apparatus of claim 19 wherein:

said chambers are formed by insert means having an essentially star-shaped horizontal cross-section, said insert means being positioned within said pressurized delivery vessel.

21. The apparatus of claim 19 wherein said delivery means includes:

a plurality of conveyor line means leading to each of said combustion points and leading from said pressurized vessel; and first nozzle means, said nozzle means positioned between said conveyor line means and said combustion points, said nozzle means accelerating said carbon/carrier gas stream to said supercritical spreed, said nozzle means having a selected diameter wherein a selected quantity of carbon corresponding to said nominal quantity will flow therethrough.

22. The apparatus of claim 21 wherein:

said nozzle means having said first diameter are interchangeable with nozzle means of other diameters in order to vary the quantity of carbon flowing therethrough.

23. The apparatus of claim 17 wherein:

said means for supplying said secondary gas stream communicates with each of said conveyor line means.

24. The apparatus of claim 19 wherein said supply means comprises:

silo means capable of storing carbon therein;

means for fluidizing said carbon from said silo means;

pneumatic conveyor means, said pneumatic conveyor means pneumatically conveying said fluidized carbon between said silo means and said pressurized delivery vessel.

25. The apparatus of claim 24 further including:

sluice vessel means communicating with said pressurized delivery vessel and said pneumatic conveyor means.

26. The apparatus of claim 25 further including:

weighing means communicating with said sluice vessel means and said pneumatic conveyor means.

27. The apparatus of claim 12 wherein:

said effectively high proportion of carbon material is 50 Kg of carbon per Kg of carrier gas.

28. The apparatus of claims 12 or 27 wherein:

said carbon is coal dust.

29. The apparatus of claim 12 wherein:

said carrier gas is air.

30. The apparatus of claim 12 wherein:

said furnace is a shaft furnace.

31. The apparatus of claim 30 wherein:

said shaft furnace is selected from the group consisting of blast furnaces and cupola furnaces.

* * * * *